US006997826B2

(12) United States Patent
Sutherland

(10) Patent No.: US 6,997,826 B2
(45) Date of Patent: Feb. 14, 2006

(54) COMPOSITE BASEBALL BAT

(75) Inventor: Willian Terrance Sutherland, Ottawa (CA)

(73) Assignee: CE Composites Baseball Inc., Ottawa (CA)

( * ) Notice: Subject to any disclaimer, the term of this patent is extended or adjusted under 35 U.S.C. 154(b) by 0 days.

(21) Appl. No.: 10/383,242

(22) Filed: Mar. 7, 2003

(65) Prior Publication Data

US 2004/0176197 A1 Sep. 9, 2004

(51) Int. Cl.
*A63B 59/06* (2006.01)

(52) U.S. Cl. ..... 473/567; 473/566

(58) Field of Classification Search ..... 473/564–568, 473/457, 519, 520
See application file for complete search history.

(56) References Cited

U.S. PATENT DOCUMENTS

| | | | | |
|---|---|---|---|---|
| 5,303,917 | A | 4/1994 | Uke | |
| 5,364,095 | A | 11/1994 | Easton et al. | |
| 5,415,398 | A | 5/1995 | Eggiman | |
| 6,042,493 | A * | 3/2000 | Chauvin et al. | 473/566 |
| 6,053,828 | A | 4/2000 | Pitsenberger | |
| 6,251,034 | B1 | 6/2001 | Eggiman et al. | |
| 6,398,675 | B1 * | 6/2002 | Eggiman et al. | 473/566 |
| 6,425,836 | B1 | 7/2002 | Misono et al. | |
| 6,440,017 | B1 | 8/2002 | Anderson | |
| 6,461,260 | B1 | 10/2002 | Higginbotham | |
| 6,482,114 | B1 | 11/2002 | Eggiman et al. | |
| 6,497,631 | B1 * | 12/2002 | Fritzke et al. | 473/566 |
| 6,612,945 | B1 | 9/2003 | Anderson | |
| 6,663,517 | B1 * | 12/2003 | Buiatti et al. | 473/566 |
| 6,733,404 | B1 * | 5/2004 | Fritzke et al. | 473/566 |
| 2002/0094892 | A1 | 7/2002 | Chauvin | |
| 2002/0198071 | A1 * | 12/2002 | Snow | 473/564 |
| 2004/0209716 | A1 * | 10/2004 | Vacek et al. | 473/567 |

* cited by examiner

*Primary Examiner*—Mark S. Graham
(74) *Attorney, Agent, or Firm*—David J. French

(57) ABSTRACT

A single member tubular baseball or softball bat of unitary construction comprised of an elongated handle portion and a striking or barrel portion wherein the barrel portion has internal and external cylindrical layers separated by one or more separation barriers, which are not bonded to said layers, located internally within the barrel thickness, and being in intimate contact with these layers. This results in equivalent or higher performing baseball bats than the prior art, as measured by hitting distance, and more consistent performance. The bats are also less costly to manufacture than prior art double walled bats.

19 Claims, 3 Drawing Sheets

FIG. 1A ( X 1 enlarged)

FIG. 2A ( X 2 enlarged)

FIG. 3A ( X 3 enlarged)

FIG. 4A ( X 4 enlarged)

FIG. 5A ( X 5 enlarged)

FIG. 6A ( X 6 enlarged)

COMPOSITE BASEBALL BAT

FIELD OF THE INVENTION

The present invention relates to baseball bats and more particularly to tubular baseball bats, constructed of a variety of materials, and more particularly to baseball bats designed to improve player performance as defined by greater hitting distance. The invention also provides a novel process for making a bat.

BACKGROUND OF THE INVENTION AND PRIOR ART

Baseball and softball bats, hereinafter referred to simply as "baseball bats", are today typically made solely from aluminum alloys, or aluminum alloys in combination with composite materials (hybrid bats), or most recently solely from composite materials. Such bats are tubular (hollow inside) in construction in order to meet the weight requirements of the end user, and have a cylindrical handle portion for gripping, a cylindrical barrel portion for striking, and a tapered mid-section connecting the handle and barrel portions.

When aluminum alloys initially replaced wooden bats in most bat categories, the original aluminum bats were formed as a single member, that is, they were made in a unitary manner as a single-walled aluminum tube for the handle, taper, and barrel portions. Such bats are often called single-wall aluminum bats. More recently (in the mid 1990's), improvements in bat design largely concentrated on bat performance (such as increased hit distance). This has been accomplished primarily by designing the barrel portion of the bat with inner or internal, and outer or external, members; these members are often referred to individually as inserts, sleeves, bodies, shells or frames in the prior art. Such two member bats are often called double-wall bats. Each member is thinner than the single walls of the prior art bats.

The prior art double-wall bats generally refer to improved performance or hit distance as trampoline effect, slugging capacity, spring, compliance, lively, rebound, flexibility, etc. resulting from the double-wall two member construction allowing the barrel portion of the bat to deflect or flex more upon ball impact which propels the ball faster and further than single-wall bats. The main engineering principle, that is, bending theory, for such improved performance is not disclosed nor understood in the prior art. Thus, optimization of hitting performance is not achieved in the prior art.

U.S. Pat. No. 5,303,917 to Uke discloses a two member bat of thermoplastic and composite materials. Such bats made of one or more thermoplastic members have proven to have neither sufficient durability nor performance in actual play.

U.S. Pat. No. 5,364,095 to Easton discloses a two member bat consisting of an external metal tube and an internal composite sleeve bonded to the inside of the external metal tube making it in effect a single-wall bat. Since the two members cannot flex independently, this is not a high performance bat.

U.S. Pat. No. 6,322,463B1 to Chauvin discloses the method of tuning a unitary member all composite bat without separation barrier(s) making it a single-wall bat and thus not a high performance bat.

U.S. Pat. No. 5,415,398 to Eggiman discloses a two member metallic bat consisting of a frame and internal insert in a double-wall construction. Further U.S. Pat. Nos. 6,251,034B1 and 6,482,114B1 disclose variations to U.S. Pat. No. 5,415,398. U.S. Pat. No. 6,440,017B1 to Anderson also discloses a two member bat with an outer sleeve and inner shell.

U.S. Pat. No. 6,063,828 to Pitzenberger discloses a two member bat consisting on an internal body and an external shell in a double-wall construction. U.S. Pat. No. 6,461,760B1 to Higginbotham discloses the bat of U.S. Pat. No. 6,053,828 with a composite shell formed to an outer shell. As the composite is bonded to the outer shell this construction acts as a double-wall bat.

Similarly, U.S. Pat. No. 6,425,836B1 to Mizuno discloses a two member bat with a lubricated coating between layers or a weak boundary layer formed on the surfaces of the inner member. Such a bat may or may not act like a double-wall bat.

U.S. Patent Pub. 2001/0094882 A1 by Clauzin discloses a two member bat consisting of an outer shell and an insert laminate partially bonded to the shell.

While the prior art two member double-wall bats have demonstrated improved performance as claimed, the opportunity for further performance improvement is significant. Also, they provide inconsistent performance improvement along the barrel portion of the bat, and from bat to bat, due to lack of precision resulting from assembling the two unjoined members which invariably results in gaps along the joint. Further, they are very costly due to the multiple manufacturing steps, and this has resulted in a many-fold increase in end user costs.

Therefore, what is needed are single member or unitary double-wall and multi-walled bats which have equal or higher performance than the prior art, which are more consistent in performance, and which are significantly less costly to manufacture.

SUMMARY OF THE INVENTION

Therefore, in view of the foregoing, a main object of the present invention is to provide a single member or unitary double-wall baseball bat with more consistent performance and having much lower costs to manufacture than the prior art two member double-wall bats. To achieve this, the bat of the present invention does not include any secondary members such as internal inserts or external sleeves. Such secondary members are costly to manufacture and costly to assemble. Further, upon assembly of such secondary members, the interface of the secondary member to the main bat frame is not precise due to the manufacturing tolerances involved. For example, in one area of the barrel, there may be an interference fit while at an adjoining area there exists a gap. Thus, performance of the bat will not be consistent along the barrel length. The double-wall bat embodiment of the present invention is effectively a single member bat of unitary construction, without any secondary members, the double-wall effect being achieved by a precise thin, separation barrier not bonded to, and located internally within the barrel wall thickness and, at least, along the majority of the barrel length, Specifically, in accordance with one aspect of the present invention, in a double-wall baseball bat of unitary construction, comprising a cylindrical handle portion for gripping, a cylindrical tubular barrel portion for striking, and a tapered mid-section connecting said handle portion and said barrel portion, a major part of the barrel portion comprises a barrel wall formed by internal and external cylindrical layers of material separated by a separation barrier which is unbonded to at least one of said layers, the separation barrier being in intimate contact with said layers over all of its area.

In accordance with another aspect of this invention, a process for forming the main object baseball bat of unitary construction of the present invention having a barrel portion, a handle portion, and a tapered portion connecting the barrel and the handle portion, the singular process comprises:

wrapping an internal layer of fiber material around a cylindrical mandrel to form an inner layer of a barrel portion of said bat, wrapping a separation barrier around said internal layer, said barrier being made of material which does not adhere to said internal layer, wrapping an external layer of fiber material around said separation barrier, said material of the external layer being such as not to adhere to the separation barrier, impregnating the fiber layers with resin, curing the resin, and withdrawing the mandrel, the process including forming said handle portion and tapered portion integrally with one or more of said layers.

Further objects and advantages of the present invention will be apparent from the following description, wherein preferred embodiments of the invention are clearly shown.

BRIEF DESCRIPTION OF THE DRAWINGS

The invention will now be described with reference to the accompanying drawings, in which:

FIG. 1A shows a cross-sectional area taken through the barrel of the FIG. 1 prior art bat. The interface between the two members shows the typical lack of precision in the fit between the two members.

FIG. 2A shows a cross-sectional area taken through the barrel of the FIG. 2 prior art bat. The interface between the two members shows the typical lack of precision in the fit between the two members.

FIG. 3A shows a cross-sectional area taken through the barrel of the FIG. 3 bat of the present invention.

FIG. 4A shows a cross-sectional area taken through the barrel of the FIG. 4 bat of the present invention.

FIG. 5A shows a cross-sectional area taken through the barrel of the FIG. 5 bat of the present invention.

FIG. 6A shows a cross-sectional area taken through the barrel of the FIG. 6 bat of the present invention.

DETAILED DESCRIPTION OF THE INVENTION

Figure 1:
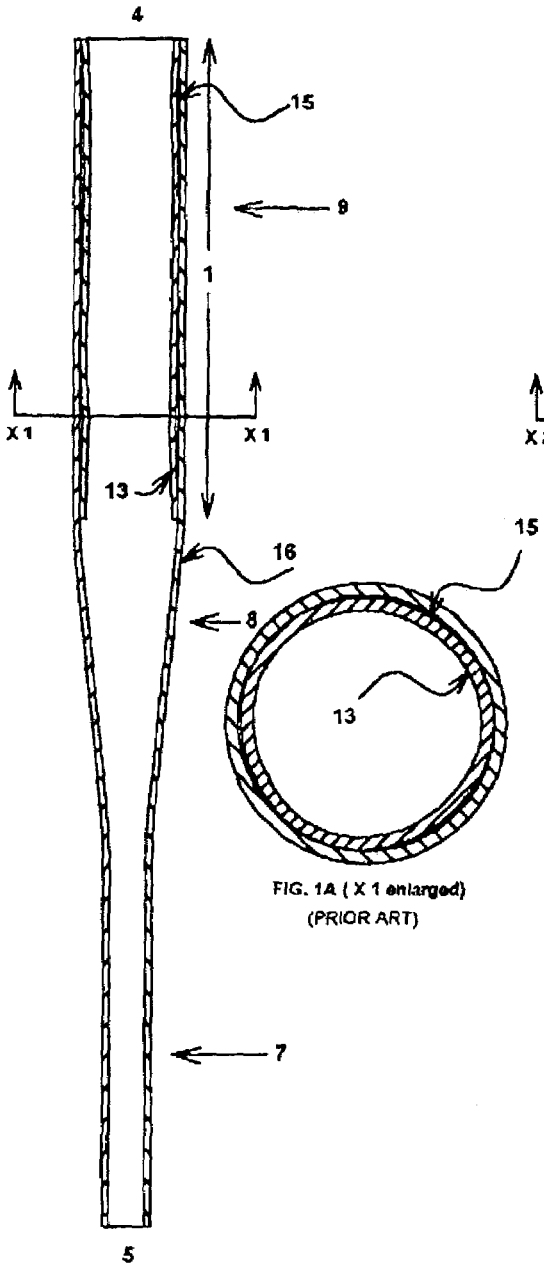
(PRIOR ART) FIG. 1 (PRIOR ART)
FIG. 1 shows a longitudinal cross-section of a typical prior art double-wall bat with two separate members, a frame or main member with an internal insert as a secondary member in the barrel area.
Figure 2:
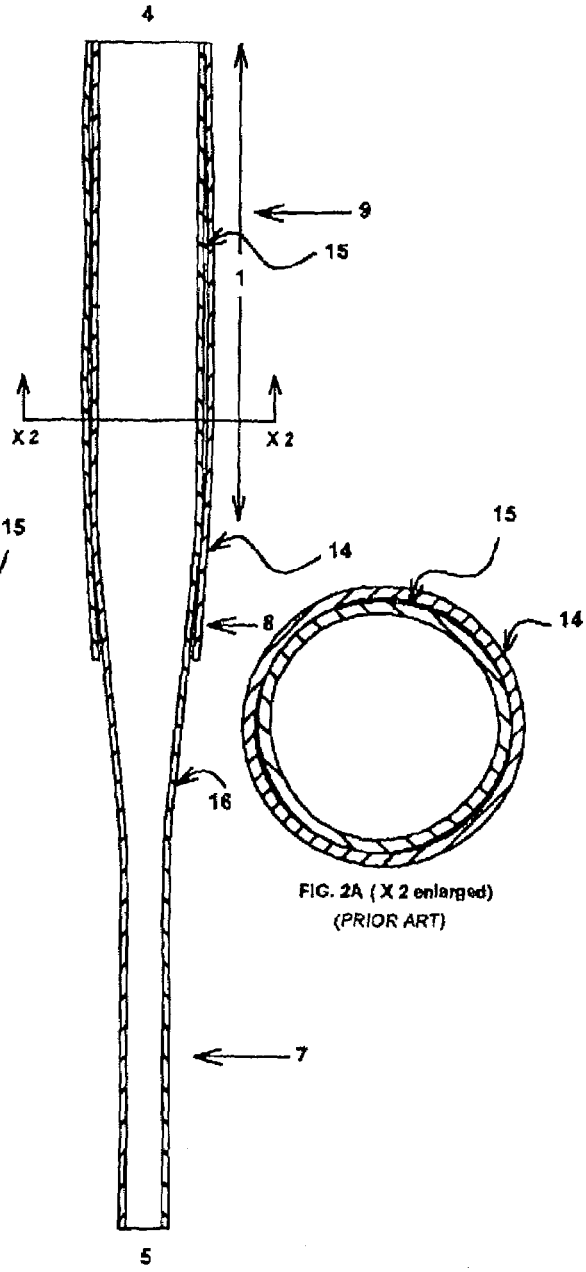
(PRIOR ART) FIG. 2 (PRIOR ART)
FIG. 2 shows a longitudinal cross-section of a typical prior art double-wall bat with two separate members, a frame or main member with an external sleeve secondary member on the barrel area.

The present invention is directed to providing single member tubular baseball bats with equivalent, or higher, and more consistent performance, consisting of a variety of materials constructed and manufactured in a singular or unitary construction (FIGS. 3, 4, 5, and 6) resulting in lower costs to manufacture relative to the prior art two member bats (FIGS. 1 and 2).

The prior art bats are shown in FIGS. 1 and 2. In FIGS. 1 and 1A, an insert 13, formed separately from the main member 16, is fitted into the barrel of this main member. In FIGS. 2 and 2A, a sleeve 14, which is formed separately from the main member 16, is fitted over the barrel portion. Both of these constructions have inconsistent performance along the barrel length 1 due to irregular areas 15, shown in FIGS. 1, 1A, 2 and 2A, where there are gaps between the two members.

Though not indicated in FIGS. 1 through 6, single member bats of the present invention, as do two member bats of the prior art, include a traditional knob (not shown in the drawings) at the handle portion end 5 and a traditional end cap (not shown in the drawings) at the barrel portion end 4, both of which can be made from a variety of materials.

Most adult tubular baseball bats have maximum outside barrel portion diameters of either 2.625 or 2.75 inches. Depending on the taper portion geometry of the mid-section 8, the barrel length 1 as defined by constant maximum diameter ranges from a few inches to 12 inches. Barrel wall thickness ranges from 0.100 inches to 0.140 inches for aluminum bats and to 0.220 inches for all composite bats.

Most youth baseball bats and softball bats have maximum outside barrel portion diameters 2 of 2.25 inches. Depending on the taper portion geometry of section 8, the barrel length 1 ranges from a few inches to 16 inches. Barrel wall thickness ranges from 0.060 to 0.090 inches for aluminum bats and to 0.220 inches for all composite bats.

Figure 3:
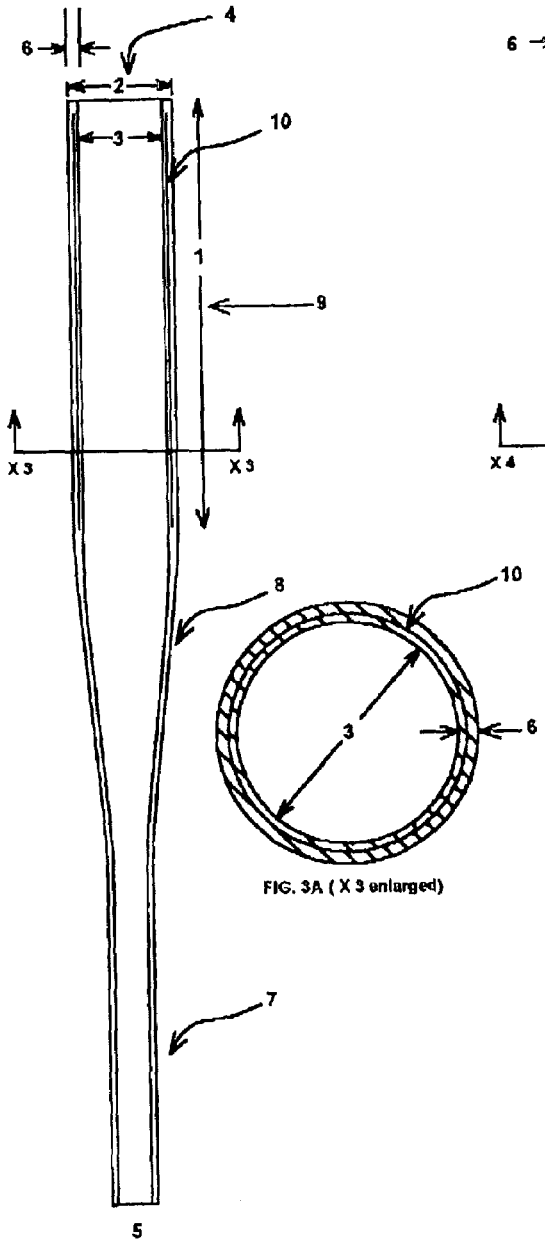
FIG. 3 shows a longitudinal cross-section of one embodiment of a double-wall single member baseball bat of unitary construction in accordance with the present invention showing a precise separation barrier located generally within the barrel area of the bat.
Figure 4:
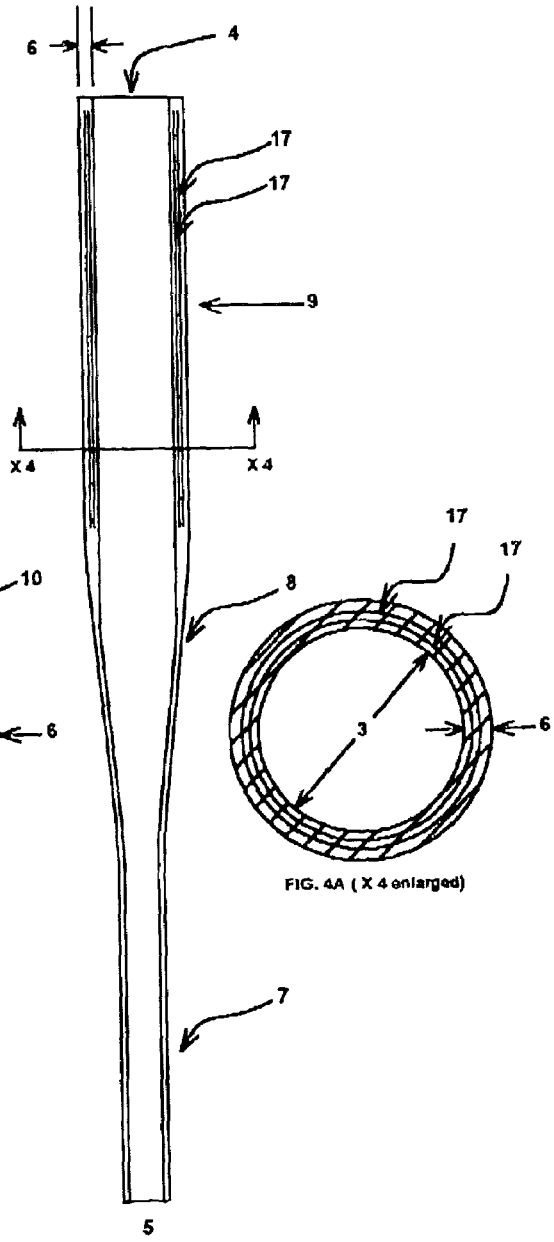
FIG. 4 shows a longitudinal cross-section of a second embodiment multi-wall single member baseball bat of unitary construction in accordance with the present invention showing more than one separation barrier located generally within the barrel area of the bat.

The single member bats of the present invention, shown in FIGS. 3 and 4 have similar dimensions to the foregoing prior art bats shown in FIGS. 1 and 2.

A first embodiment of the present invention FIG. 3 is a single member double wall all polymer composite baseball bat consisting of a cylindrical handle portion 7 for gripping, a cylindrical tubular barrel portion 9 for striking or hitting, and a tapered mid-section 8 connecting the handle 7 and barrel 9 portions, with a precise separation barrier 10 located internally within the barrel thickness 6 and extending longitudinally along the majority of the barrel length 1.

A polymer composite is a non-homogenous material consisting of continuous fibers embedded in, and wetted by, a polymeric resin matrix whereby the properties of the material are superior to those of its constituent fibers and resin taken separately. Such polymer composites are anisotropic materials since they exhibit different responses to stresses applied in different directions depending on how the fibers are aligned within the matrix.

Other materials commonly used in bat constructions such as aluminum, wood and plastics, are not anisotropic and are thus limited in optimizing bat performance. However, with the composite materials which are preferred, properties of bats made in accordance with the present invention, such as strength, stiffness and durability, can be controlled by altering the fiber alignments along the bat.

Generally, the fiber materials used are selected from a group consisting of glass fibers, graphite or carbon, aramid, boron, nylon fibers, or hybrids of any of the foregoing all of which are commercially available. The resins used to impregnate, wet out, and encapsulate or imbed the fiber materials are generally selected from a group consisting of epoxy, polyester, vinyl ester, urethane, or a thermoplastic such as nylon, or mixtures thereof.

The first embodiment FIG. 3 includes a thin separation barrier 10 precisely located within the barrel portion 9 thickness 6 resulting in a single member or unitary double-wall bat. The separation barrier may, or may not, extend to the barrel end. The double wall, single member bat results in high performance as subsequently explained. In the manufacture of the first embodiment bat FIG. 3 in a single operation, the selected fibers are placed typically over a metal mandrel or tool, which is subsequently removed, this tool having external tool dimensions matching the required finished internal bat dimensions 3. When the amount of fibers is approximately half the desired finished thickness 6, the thin separation barrier 10 is placed circumferentially around the length of the barrel portion 1 and the remaining fibers placed over the separation barrier 10. Then, the single member or unitary construction is impregnated with liquid resin utilizing one of a variety of techniques used within the composite industry, and subsequently the resin is hardened by curing resulting in a single member double-wall bat FIG. 3. This bat accordingly has an internal layer of impregnated material separated from an external layer of the same material by the separation barrier 10, and both the internal and external layers of material are integral with the material of the handle 7 and the mid-section 8.

As the first embodiment bat of FIG. 3 is made as a double-wall construction, the result is a high performance bat. As the thin separation barrier 10, following resin impregnation is in uniform and consistent contact with the composite along the barrier boundaries, the performance is fully consistent along the barrel length 1 containing the separation barrier 10. The prior art bats of FIGS. 1 and 2 have inconsistent performance along the barrel length 1 due to irregular areas 15 not in direct contact with the bat frame 16. Further, as the first embodiment bat of FIG. 3 does not incorporate costly sleeve(s) 14 or insert(s) 13 or other secondary members of the prior art, and is manufactured in a unitary or single operation, its manufacturing costs are relatively low.

The separation barrier 10 of the present invention is typically on the order of 0.003 inches thick with a tolerance of + or −0.002 inches. It is nonstructural in that it does not, of itself, contribute significantly to the stiffness and strength of the barrel portion of the bat. It can be made of a polymeric or plastic material, or waxed paper. The separation baffler 10 is generally easy to conform to the barrel circumference and must not stick to the resin employed and not be wetted-out by the resin in order to provide the double-wall performance benefit.

Figure 5:
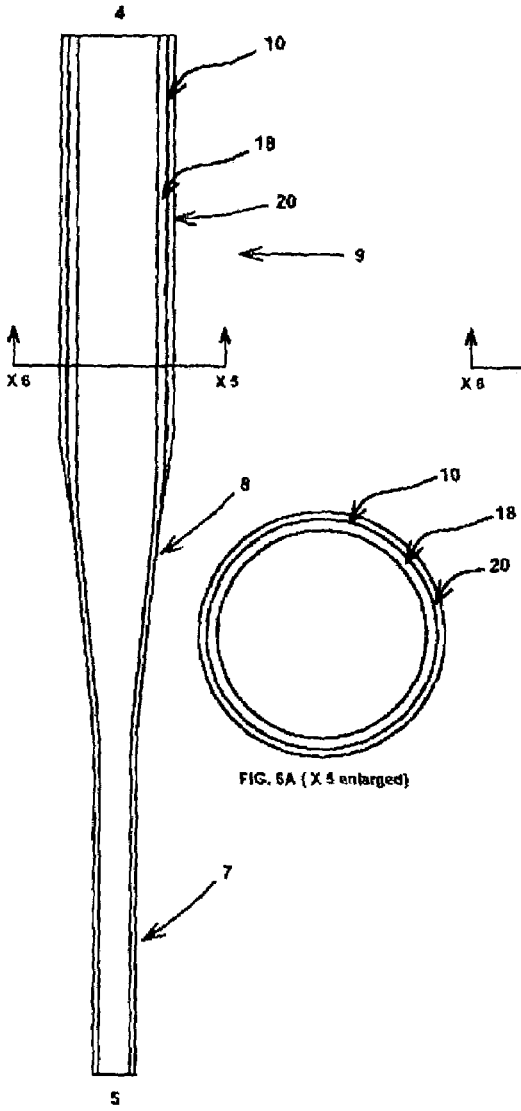
FIG. 5 shows a longitudinal cross-section of a third embodiment double-wall single member bat of unitary construction in accordance with the present invention showing a precise separation barrier located generally within the barrel area separating an internal metallic frame and an external polymer composite layer.

Another embodiment, FIG. 5, which also provides the benefits of high performance, more consistent performance and low manufacturing costs, is a bat wherein an internal metallic tube or frame 18 is used as a sacrificial mandrel or tool and remains incorporated in the bat. The separation barrier 10 is placed over the barrel portion 9 of the frame 18, the fibers 20 are placed over the separation barrier 10, and the single member bat is impregnated with resin and subsequently cured as before. There is no tool to remove in this embodiment. This bat is also a single member bat of unitary construction in that it is formed in one operation and its internal and external layers are both in intimate contact with the separation barrier. In a variation of this embodiment of the present invention, not shown, the fibers 20 may extend over the taper portion 8 and/or handle portion 7 before resin impregnation and curing.

Figure 6:
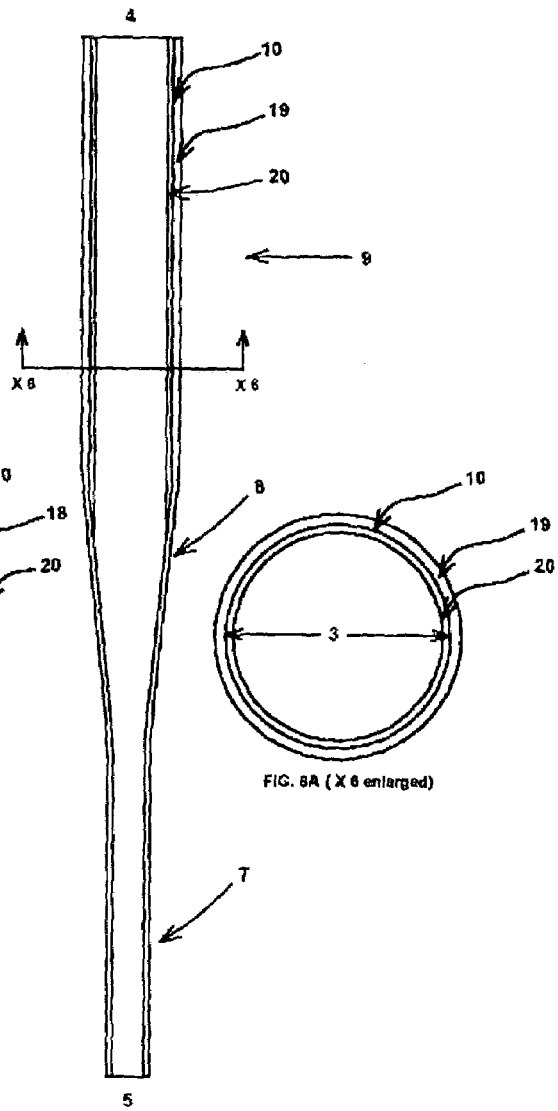
FIG. 6 shows a longitudinal cross-section of a fourth embodiment double-wall single member bat of unitary construction in accordance with the present invention showing a precise separation barrier located generally within the barrel area separating an external metallic frame and an internal polymer composite layer.

Similarly, another embodiment of the present invention FIG. 6 which is a single member bat of unitary construction and also provides the same benefits, is one in which the separation barrier 10 is placed within a metallic frame 19 in the form of a cylindrical tube and the fibers 20 placed on the inside of the separation barrier 10, and subsequently impregnated with resin and cured. In a variation of this embodiment of the present invention, not shown, the fibers 20 may extend over the taper portion 8 and/or handle portion 7 before resin impregnation and curing.

In the embodiments described in the foregoing and further embodiments to be described, the scientific principle governing improved bat performance is bending theory. When a ball impacts a bat it has kinetic energy that must be absorbed by the bat in order to stop the ball. The bat stores this energy by flexing. After the ball is stopped, the bat returns the energy it stored by rebounding and sending the ball back towards where it came from. The more the bat barrel portion 9 deforms upon ball impact without failing (denting or breaking), the lower the energy loss in the ball, and the greater the energy return to the ball from the bat as the bat barrel portion 9 impacted returns to its original shape.

Bat performance and bat durability features are offsetting. That is, higher performance bats require thinner barrel portion wall thicknesses 6, which are those more prone to denting and breakage due to their thinner walls. Due to bending theory principles, double-wall bats deform more upon ball impact than single-wall bats while remaining relatively durable.

More specifically, in comparing a single wall with a double-wall bat, if both have equal overall thickness, bending theory dictates that the stiffness of a single-wall bat with thickness equal to the total double-wall thickness is four times that of the double-wall bat. This is because stiffness increases with thickness cubed. Each layer of the double-wall bat has half the thickness, and therefore, since there are two walls working together, the stiffness is $2\times\frac{1}{8}=\frac{1}{4}$ or 25% of the single wall bat. This is why double-wall bats are higher performing, or longer hitting, bats than single-wall bats.

Similarly, if more than two walls, for example, three walls, not joined or bonded to each other are employed, bending theory results in a multi-walled bat whose stiffness is 11% of single-wall bat of the same thickness and 44% that of a double-wall bat of the same total thickness. Thus, multi-walled bats, or bats with more than two walls not joined or bonded together, are higher performing bats than double-wall bats of the prior art.

Thus, another preferred embodiment FIG. 4 of the present invention includes two or more thin separation barriers 17 precisely located within the barrel portion thickness 6 resulting in a single member multi-wall bat. The separation barriers 17 may, or may not, extend to the barrel end. The multi-wall single member bat FIG. 4 results in a higher performance bat than the prior art double-wall two member bats of FIGS. 1 and 2 as previously explained. The manufacture of the single member, multi-wall bat of the FIG. 4 embodiment of the present invention is essentially identical to the double-wall embodiment previously described with the exception that two or more separation barriers 17 are employed. Thus, in the multi-wall bat embodiment there is one more layer of fibers than there are separation barriers. As in the third and fourth embodiments, a metallic frame can be utilized with the fibers and separation barriers are placed either externally or internally on the frame. In all embodiments of the multi-wall bat, the present invention of FIG. 4 results in higher performance bats than the prior art double bats FIGS. 1 and 2, more consistent performing bats, and as the unitary construction is manufactured in a single operation, the manufacturing costs are relatively low.

Following extensive in-house development and testing, an external laboratory specializing in collision dynamics and a university with expertise in frequency analysis were employed to test numerous bats of the present invention. External testing began a number of years ago and continued through early 2003. Eighty-four different bats relating to the present invention were externally tested by shooting baseballs at the bats from a precise cannon or controlled speeds up to 160 mph and recording entrance and exit ball speed. Then coefficients of restitution (ratio of exit to entrance ball speeds) were calculated for each bat construction, which is a direct indicator of bat performance. Conclusive evidence of the superior performance of bats of the present invention was obtained. Further, optimal designs were achieved through the reiteration testing methodology employed. Further, the frequency analyses utilized furthered the development process as bat frequencies are directly related to thickness and stiffness.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

I claim:

1. A baseball bat comprising a cylindrical handle portion for gripping, a cylindrical tubular barrel portion for striking, and a tapered mid-section connecting said handle portion and said barrel portion, wherein a major part of said barrel portion comprises a barrel wall thickness formed by internal and external cylindrical structural layers of material separated by a separate nonstructural layer forming a separation barrier which is:

a) non-adherent to the material of both the internal and external cylindrical structural layers and unbonded to at least one of said adjacent structural layers, b) in the form of thin, conformable, solid, tubular polymeric materials, c) in intimate contact with said internal and external cylindrical structural layers over all of its area, and d) nonstructural in that it does not, of itself, contribute significantly to the stiffness and strength of the barrel portion of the bat.

2. A bat according to claim 1, wherein said bat is of unitary construction by reason of having both of said internal and external cylindrical structural layers of material integrally formed with the material of the tapered mid section and the handle portion.

3. A bat according to claim 1, wherein said separation barrier is on the order of 0.003" inches in thickness with a tolerance on the order of +–0.002.

4. A bat according to any one of claim 1, 2 or 3 wherein said structural layers of material comprise a polymer composite.

5. A bat according to claim 4 wherein said polymer composite material of the structural layers comprises a resin matrix encapsulating reinforcement fibers wherein said resin is selected from the group of resins consisting of epoxy, vinyl ester, polyester, urethane, nylon, and mixtures thereof and wherein said reinforcement fibers are selected from the group consisting of glass fibers, and fibers of graphite, carbon, aramid, boron, nylon, and mixtures thereof.

6. A bat according to claim 5 wherein said polymer composite material forms the external layer of at least said barrel wall and a metallic material forms the internal layer of said barrel wall, and wherein the separation barrier is located between said polymer composite material and said metallic material.

7. A bat according to claim 6 wherein said metallic material is selected from a group consisting of aluminum, titanium, and steel.

8. A bat according to claim 5 wherein a metallic material forms the external layer of said barrel wall and said polymer composite material forms the internal layer of said barrel wall, and wherein the separation barrier is located between said metallic material and said polymer composite material.

9. A baseball bat as in claim 1, 2 or 3 wherein at least one of said internal and external cylindrical structural layers comprise one or more multiple structural layers, adjacent pairs of said multiple structural layers being separated by an additional separation barrier which is:

a) non-adherent to the material of both of the adjacent multiple structural layers and unbonded to at least one of said adjacent structural layers, b) in the form of a thin, conformable, solid, tubular material, c) in intimate contact with said adjacent structural layers over all of the area of such additional separation barrier, and d) nonstructural in that it does not, of itself, contribute significantly to the stiffness and strength of the barrel portion of the bat.

10. A bat according to claim 9 wherein said additional separation barrier is on the order of 0.003 inches in thickness with a tolerance on the order of +or –0.002 inches.

11. A bat according to claim 9 wherein said additional separation barrier comprises polymeric material.

12. A bat according to claim 9 wherein said additional separation barrier is of a non-metallic material.

13. A bat according to claim 9 wherein said additional separation barrier is a waxed paper.

14. A bat according to claim 9 wherein said material of at least one of said structural layers comprises polymer composite.

15. A bat according to claim 14 wherein said polymer composite material comprises a resin matrix encapsulating reinforcement fibers wherein said resin is selected from the group of resins consisting of epoxy, vinyl ester, polyester, urethane, nylon, and mixtures thereof and wherein said reinforcement fibers are selected from the group consisting of fiberglass, graphite, carbon, aramid, boron, nylon, and mixtures thereof.

16. A bat according to claim 9 wherein at least one of said internal and external structural layers comprises a metallic material.

17. A bat according to claim 16 wherein said metallic material is selected from a group consisting of aluminum, titanium, and steel.

18. A baseball bat comprising a cylindrical handle portion for gripping, a cylindrical tubular barrel portion for striking, and a tapered mid-section connecting said handle portion and said barrel portion, wherein a major part of said barrel portion comprises a barrel wall thickness formed by an un-even number of alternating layers comprising thick, structural layers of material separated by thin, separate, non-structural material layers, wherein each of said nonstructural layers is:

a) unbonded to at least one of said adjacent structural layers, b) in the form of a thin, conformable solid, tubular material, c) in intimate contact with said structural material layers over all of its area, and d) nonstructural in that it does not, of itself, contribute significantly to the stiffness and strength of the barrel portion of the bat.

19. A baseball bat as in claim 18 wherein the nonstructural material layers are on the order of 0.003 inches in thickness with a tolerance of on the order of +or −0.002 inches.

* * * * *